US012178314B1

(12) United States Patent
Oros

(10) Patent No.: US 12,178,314 B1
(45) Date of Patent: Dec. 31, 2024

(54) BOTTLE CLEANING SYSTEM AND METHOD

(71) Applicant: Matthew Alan Oros, Adelanto, CA (US)

(72) Inventor: Matthew Alan Oros, Adelanto, CA (US)

( * ) Notice: Subject to any disclaimer, the term of this patent is extended or adjusted under 35 U.S.C. 154(b) by 362 days.

(21) Appl. No.: 17/855,470

(22) Filed: Jun. 30, 2022

Related U.S. Application Data

(60) Provisional application No. 63/218,058, filed on Jul. 2, 2021.

(51) Int. Cl.
*A46B 5/00* (2006.01)
*A46B 7/02* (2006.01)

(52) U.S. Cl.
CPC ..... *A46B 5/0079* (2013.01); *A46B 5/0008* (2013.01); *A46B 5/0095* (2013.01); *A46B 7/023* (2013.01); *A46B 2200/3006* (2013.01)

(58) Field of Classification Search
CPC ..... A46B 5/0008; A46B 9/0095; A46B 7/023; A46B 2200/3006
See application file for complete search history.

(56) References Cited

U.S. PATENT DOCUMENTS

| | | | | |
|---|---|---|---|---|
| 6,202,247 | B1 | 3/2001 | Lorenz, Jr. | |
| 6,349,443 | B1 | 2/2002 | Randolph et al. | |
| 7,473,046 | B2 * | 1/2009 | Kraus | A46B 11/0072 401/24 |
| 9,113,758 | B1 * | 8/2015 | O'Brien | A47K 11/10 |
| 9,265,334 | B1 | 2/2016 | Fung-A-Wing | |
| 10,334,941 | B2 | 7/2019 | Hanneken et al. | |
| 10,791,823 | B2 | 10/2020 | Lee et al. | |
| 2007/0274762 | A1 | 11/2007 | Edwards et al. | |
| 2013/0013529 | A1 | 1/2013 | Chheda et al. | |
| 2017/0215577 | A1 | 8/2017 | Jeanty et al. | |

FOREIGN PATENT DOCUMENTS

| | | | |
|---|---|---|---|
| KR | 100609488 | B1 | 8/2006 |

* cited by examiner

*Primary Examiner* — Shay Karls

(74) *Attorney, Agent, or Firm* — John Rizvi; John Rizvi, P.A.—The Patent Professor®

(57) ABSTRACT

A bottle cleaning system, for cleaning baby bottles and other containers, includes a bottle cleaning device having several different sets of cleaning bristles. The bottle cleaning device generally includes a handle having a shaft, a first set of bristles mounted on a compressible sleeve and surrounding the shaft of the handle and a second set of bristles mounted on the shaft of the handle. The bottle cleaning device further includes an end cap at an end of the first set of bristle and having a through bore and an opening for passage of the second set of bristles. A biasing spring biases the end cap away from the handle to initially cover the second set of bristles. A third set of bristles is removable retained within a hollow channel in the handle.

20 Claims, 6 Drawing Sheets

BOTTLE CLEANING SYSTEM AND METHOD

CROSS-REFERENCE TO RELATED APPLICATION

This application claims the benefit of U.S. Provisional Patent Application No. 63/218,058, filed on Jul. 2, 2021, which is incorporated by reference herein in its entirety.

FIELD OF THE INVENTION

The present invention relates generally to bottle cleaning brushes, and more particularly, to an apparatus having multiple brushes for cleaning a baby bottle.

BACKGROUND OF THE INVENTION

Cleaning bottles by hand is often necessary to prevent bottle breakage and to ensure that the entire bottle gets fully cleaned. This is particularly true where the bottles in question are used to supply humans with various liquids. Lingering residue and contaminants are always a health concern under these conditions.

Bottles for use in providing liquids to humans can be designed for a single use, or may be designed to be reused. In order to properly clean, and subsequently sanitize, these reusable bottles the cleaner must be sure to scrub all the remaining residue and particulates off of the bottles with cleaning brushes. Given the varying shapes and sizes of bottles used in today's society, that may require more than one size of cleaning brush.

Baby bottles, for instance, often require a number of different size and/or stiffness brushes to adequately clean the various areas and components of the baby bottles. For example, the outside and especially the inside of the main bottle structure is best and most efficiently cleaned with a brush having relatively large and stiff bristles. Other components of the baby bottle, such as the delicate and flexible cap, may require the user to use a softer, smaller diameter brush to avoid damage to the delicate cap and any associated nipple thereon.

Still further, many newer baby bottles include structure in the form of tubes or vent pipes to reduce or eliminate the possibility of an infant ingesting air which could lead to colic. These colic preventing devices and features have a generally very small diameter requiring a very small diameter brush to effectively clean out the interiors of the colic preventing devices.

Thus, in order to effectively clean a bottle containing multiple differing size structures, a user may need brushes of varying diameters to access all the areas. Additionally, due to the differing materials the bottle and caps/nipples and colic devices are made out of, the user may further need brushes of varying stiffness and softness to effectively clean the harder surfaces and avoid damage to the softer material surfaces.

The brushes themselves also need to be cleaned to keep them sanitary. Thus, requirement to possess and maintain multiple brushes for cleaning a single type of bottle can become costly and burdensome.

Accordingly, there is need for a solution to at least one of the aforementioned problems. For instance, there is an established need for bottle cleaning system or device which reduces the number of brushes involved in cleaning a baby bottle, preferably in such a way that the system or device may safely clean harder and softer bottle parts.

SUMMARY OF THE INVENTION

The present invention is directed to a bottle cleaning system including a bottle cleaning device having several different sets of cleaning bristles. The bottle cleaning device may include a handle having a shaft, a first set of bristles mounted on a compressible sleeve and surrounding the shaft of the handle and a second set of bristles mounted on the shaft of the handle. The bottle cleaning device may further include an end cap at an end of the first set of bristle and having a through bore and an opening for passage of the second set of bristles. A biasing spring may bias the end cap away from the handle to initially cover the second set of bristles. The second set of bristles may be exposed by pressing on the end cap and while compressing the first set of bristles. A third set of bristles may be removably retained within a hollow channel in the handle.

In a first implementation of the invention, a bottle cleaning system may include a bottle cleaning device. The bottle cleaning device may include a handle, a handle shaft, an end cap, a sleeve, a first set of bristles and a second set of bristles. The handle shaft may be affixed to and extend from the handle in a longitudinal direction. The end cap may include a through bore arranged in the longitudinal direction, and may be arranged in spaced-apart configuration with the handle and movable longitudinally towards and away from the handle. The sleeve may be elongately formed between and extending longitudinally from the handle and the end cap. The sleeve may define a channel formed longitudinally through the sleeve, and may be compressible and expandable along the longitudinal direction. The first set of bristles may be carried by the sleeve and may be longitudinally compressible and expandable. The second set of bristles may be carried by the handle shaft, and may be longitudinally movable within and along the channel of the sleeve and the through bore of the end cap. The sleeve and first set of bristles may be compressible towards the handle, and the second set of bristles may be exposable out of the through bore of the end cap, by a longitudinal movement of the end cap towards the handle. Conversely, the sleeve and first set of bristles may be expandable away from the handle, and the second set of bristles may be retractable into the through bore of the end cap, by a longitudinal movement of the end cap away from the handle.

In a second aspect, the handle shaft may be non-movable longitudinally relative to the handle.

In another aspect, the second set of bristles may be non-movable longitudinally relative to the handle.

In another aspect, the handle may be elongately formed in the longitudinal direction.

In another aspect, the handle, handle shaft, sleeve, through bore of the end cap, first set of bristles, and second set of bristles may be coaxial along a central axis formed in the longitudinal direction.

In yet another aspect, the bottle cleaning device may be spring-biased to move the end cap longitudinally away from the handle, to expand the sleeve and first set of bristles away from the handle, and to retract the second set of bristles and handle shaft into the through bore of the end cap.

In another aspect, the bottle cleaning device may include a compression spring extending longitudinally from and between the handle to the end cap.

In another aspect, the handle shaft and the second set of bristles may extend longitudinally through and along the compression spring.

In another aspect, the sleeve may extend from and may be integrally formed with an underside of the end cap.

In yet another aspect, the sleeve may be integrally formed with the end cap into a single-piece unit.

In another aspect, the first set of bristles may be wider than the handle.

In another aspect, the second set of bristles may be narrower than the first set of bristles.

In another aspect, the first set of bristles may be integrally formed with the sleeve into a single-piece unit.

In yet another aspect, the second set of bristles may be integrally formed with the handle shaft into a single-piece unit.

In another aspect, the handle shaft may be integrally formed with the handle into a single-piece unit.

In another aspect, the bottle cleaning device may further include a third set of bristles removably receivable within a cavity formed in the handle.

In another aspect, the handle may be elongately formed in the longitudinal direction. The bottle cleaning device may include a base cap. The third set of bristles may extend radially outward of a second shaft carried by and extending from the base cap. The base cap and second shaft may be mountable to the handle such that the second shaft and third set of bristles are received within the cavity and are arranged in the longitudinal direction.

In yet another aspect, the third set of bristles may be wider than the second set of bristles and narrower than the first set of bristles.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward a bottle cleaning system comprising a multi-bristle bottle cleaning device having a plurality of sets of bristles for cleaning various portions of a baby bottle.

Figure 1:
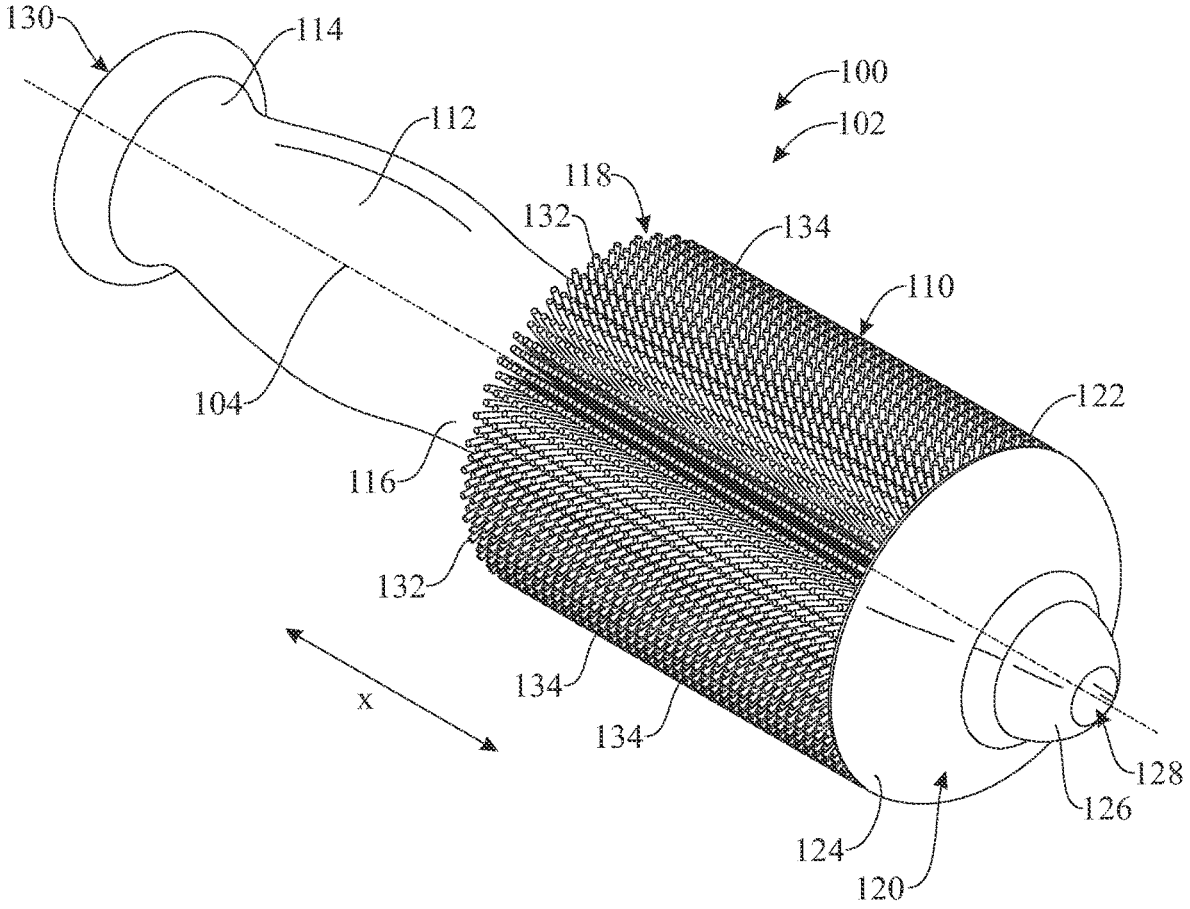
FIG. 1 presents a top front isometric view of a multi-bristle bottle cleaning device for use in cleaning baby bottles accordance with a first illustrative embodiment of the present invention and illustrating a first set of cleaning bristles.
Figure 2:
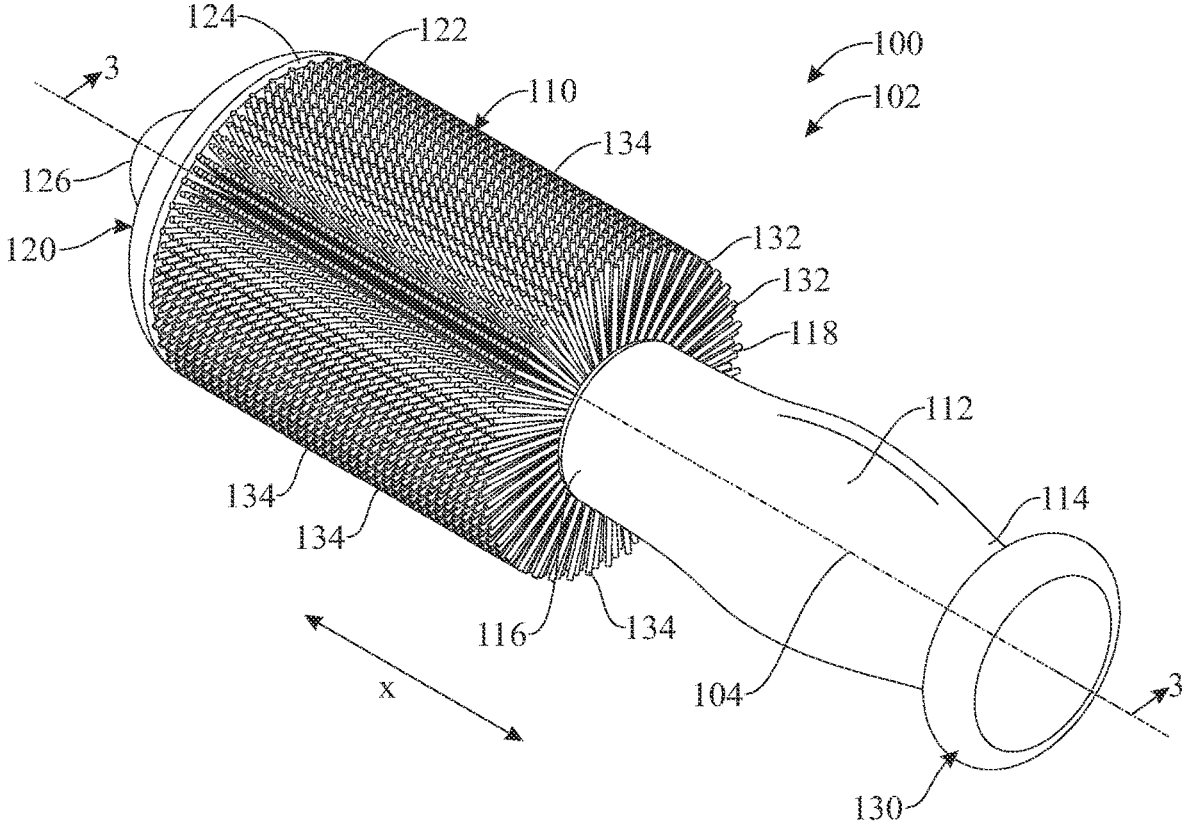
FIG. 2 presents a top rear isometric view of the bottle cleaning device of FIG. 1.
Figure 3:
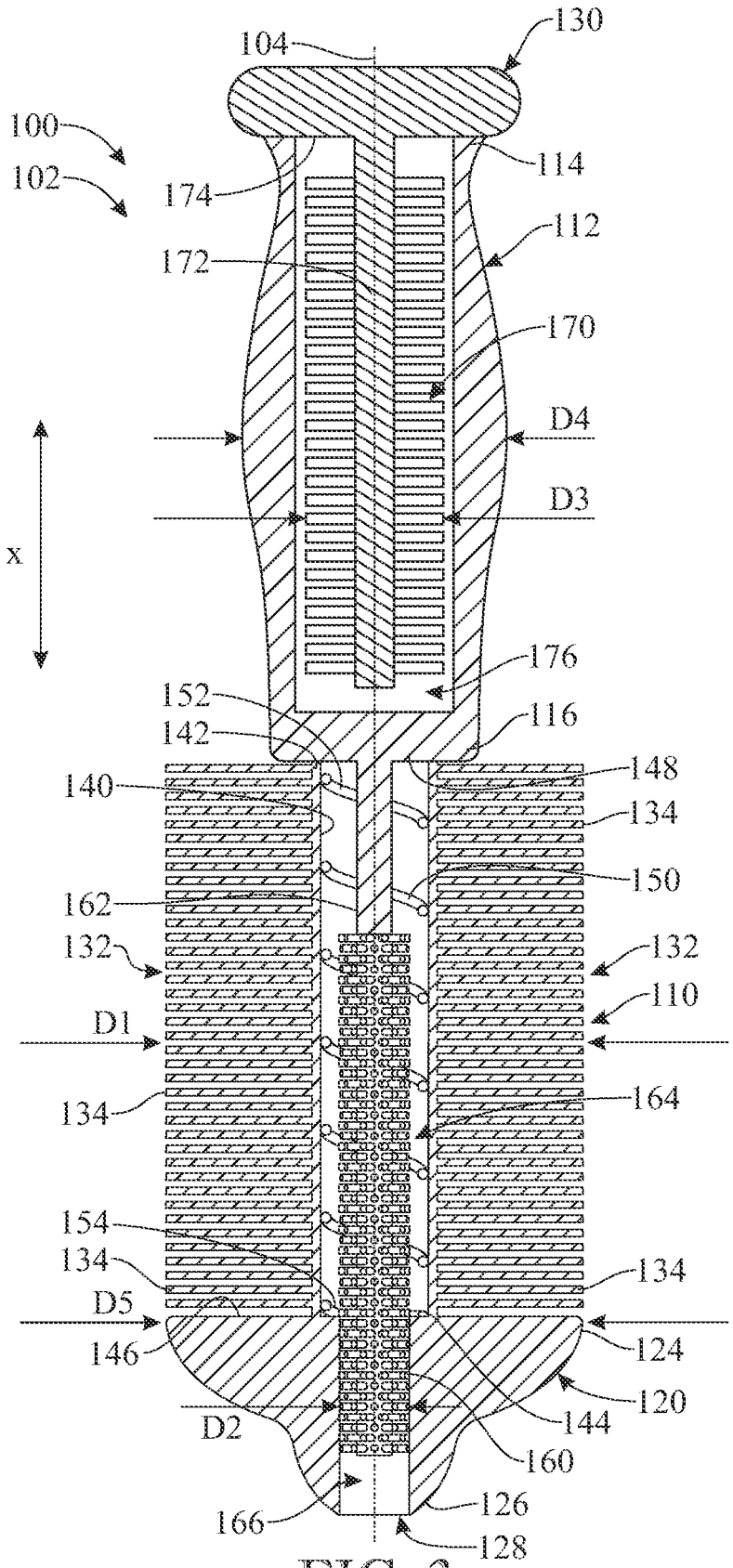
FIG. 3 presents a cross-sectional side elevation view of the bottle cleaning device of FIG. 1, the cross section taken along section plane 3-3 indicated in FIG. 2, illustrating a second set of cleaning bristles retained within the first set of cleaning bristles and a third set of cleaning bristles removably mounted within a handle of the bottle cleaning device, the bottle cleaning device shown in an extended configuration.

Referring to FIGS. 1-3, and initially with regard to FIGS. 1 and 2, a bottle cleaning system 100 including a multi-bristle bottle cleaning device, hereinafter bottle cleaning device 102, is illustrated in accordance with an exemplary embodiment of the present invention. The bottle cleaning device 102 generally includes a first set of bristles 110 for cleaning a baby bottle, and a handle 112 affixed to the first set of bristles 110 for manipulating the first set of bristles 110 relative to the baby bottle. The first set of bristles 110 are provided for cleaning specific portions of a baby bottle, for example, the bulk of the interior and exterior of a baby bottle. In some embodiments, such as the present embodiment, the first set of bristles 110 may be elongate and extend generally along a longitudinal direction x. The first set of bristles 110 may be generally cylindrical, i.e. may define a generally cylindrical outer brushing contour or edge formed about a central longitudinal axis 104; as indicated in FIG. 3, the generally cylindrical, first set of bristles 110 has an outer diameter D1. In some embodiments, such as the present embodiment, the bristles (hereinafter referred to as bristles 134) forming the first set of bristles 110 may be arranged radially relative to the central longitudinal axis 104, as shown for instance in FIGS. 2 and 3.

With continued reference to FIGS. 2 and 3, the handle 112 of the present embodiment is generally elongated and has an oval shape to better fit a user's hand. In some embodiments, such as the present embodiment, the handle 112 may be elongately formed along the longitudinal direction x, similarly to the first set of bristles 110. For example, the handle 112 may be generally coaxial with the first set of bristles 110, as shown, such that the handle 112 is also generally formed around the central longitudinal axis 104. The handle has a proximal or first end 114 and a distal or second end 116. A proximal or first end 118 of the first set of bristles 110 extends from and is mounted relative to the second end 116 of the handle 112. A end cap 120, better shown in FIG. 1, is mounted or otherwise affixed to a distal or second end 122 of the first set of bristles 110. Specifically, the end cap 120 of the present embodiment has a proximal or first end 124 adjacent the second end 122 of the first set of bristles 110 and a distal or second end 126 defining an opening 128. The end cap 120 of the present embodiment is movably mounted relative to the handle 112 in manner described in more detail hereinbelow.

A base cap 130 is removably attached to the proximal or first end 114 of the handle 112. The base cap 130 may be removably attached to the handle 112 in a variety of ways, such as, but not limited to, a threaded connection, a quick or quarter-turn bayonet-type connection, a magnetic connection, a friction fit connection, etc.

The first set of bristles 110 includes a plurality of longitudinally extending rows 132 of individual bristles 134. Each row 132 includes a plurality of individual bristles 134 arranged in longitudinal alignment or forming said row along the longitudinal direction x. The individual bristles 134 may extend radially, as mentioned heretofore, such that the bristles 134 of each row 132 are arranged at a respective angular position relative to the central longitudinal axis 104; thus, each row 132 is arranged at a respective angular position relative to the central longitudinal axis 104. The plurality of rows 132 may extend about an entire periphery of, or 360 degrees about, the central longitudinal axis 104, as shown.

The individual bristles 134 can be formed from a variety of synthetic and/or organic materials. For example, the individual bristles 134 may be formed from a metallic material such as, but not limited to, stainless steel, aluminum, brass or bronze, etc. Alternatively, the individual bristles 134 may be formed from a plastic or polymeric material, such as, but not limited to, nylon, silicone, etc.

In another embodiment, the individual bristles 134 of the first set of bristles 110 may be formed from a variety of organic materials including plant and/or animal material. For example, the individual bristles 134 may be formed from a plant material such as, but not limited to, bamboo, reed or other grasses, natural plant fibers and the like. Alternatively, the individual bristles 134 may be formed from a variety of animal based materials such as, but not limited to, bone, hair or wool, etc.

Preferably, the individual bristles 134 of the first set of bristles 110 are formed from one or more materials that are easily cleanable and/or sterilizable for the safety and health of a baby coming into contact with a baby bottle cleaned by the disclosed bottle cleaning device 102.

Similarly, the handle 112, the end cap 120 and the base cap 130 may be formed from a variety of similar synthetic and/or organic materials. For example, the handle 112, the end cap 120 and the base cap 130 may be formed from a synthetic material such as, but not limited to, a polymeric material. The handle 112, in particular, may be formed from or otherwise treated with a rubber or rubberized material to enhance the user's grip on the handle 112 or otherwise surface treated to enhance grip. Alternatively, the handle 112 and/or the end and base caps 120 and 130, respectively, may be formed from an attractive wood for aesthetic purposes.

Turning now to FIG. 3, the first set of bristles 110, including the longitudinally extending bristle rows 132 and individual bristles 134, are mounted on a compressible, hollow inner sleeve 140. The inner sleeve 140 may be elongately formed along the longitudinal direction x, as shown, and extend proximally from the end cap 120. The inner sleeve 140 includes a proximal or first end 142 and a distal or second end 144. The distal or second end 144 of the inner sleeve 140 extends from an underside, or proximal side or face 146, at the proximal or first end 124 of the end cap 120. The proximal or first end 142 of the inner sleeve 140 abuts an end or distal face 148 at the second end 116 of the handle 112. The proximal face 146 and/or distal face 148 may be generally flat and oriented radially, i.e. perpendicularly or transversely to the central longitudinal axis 104. The proximal face 146 of the end cap 120 and the distal face 148 of the handle 112 may be parallel to one another. For instance, in the present embodiment, the proximal face 146 and distal face 148 are flat, radially-oriented, and parallel to one another.

As noted hereinabove, the first set of bristles 110 can be formed from a variety of materials. The first set of bristles 110 can be mounted on or otherwise affixed to the inner sleeve 140. Alternatively, the first set of bristles 110 can be formed integrally with the compressible inner sleeve 140. The inner sleeve 140 is formed from a material that is flexible or compressible in order to retract the first set of bristles 110 relative to the handle 112 in a manner described in more detail hereinbelow.

In order to bias and maintain the first set of bristles 110 in an initial and extended condition relative to the handle 112, shown in FIGS. 1-3, the bottle cleaning device 102 further includes a compression spring or biasing spring 150 (FIG. 3) having a first end 152 abutting the distal face 148 of the handle 112 and a second end 154 abutting the proximal face 146 of the end cap 120. The biasing spring 150 is configured to force the end cap 120 away from the distal face 148 of the handle 112. The biasing spring 150 may be arranged longitudinally, as shown. In the present embodiment, the biasing spring 150 is retained within a through bore or channel 164 defined within and along the hollow inner sleeve 150, and is coaxial with the handle 112 and first set of bristles 110. The biasing spring 150 can be formed from any spring material including stainless steel, etc. The biasing spring 150 allows the end cap 120, and thus the first set of bristles 110, to reversibly move from the initial fully extended condition, shown in FIGS. 1-3, to a fully retracted condition, shown in FIG. 4, where first set of bristles 110 are compressed and the end cap 120 is close to the distal face 148 of the handle 112.

Figure 4:
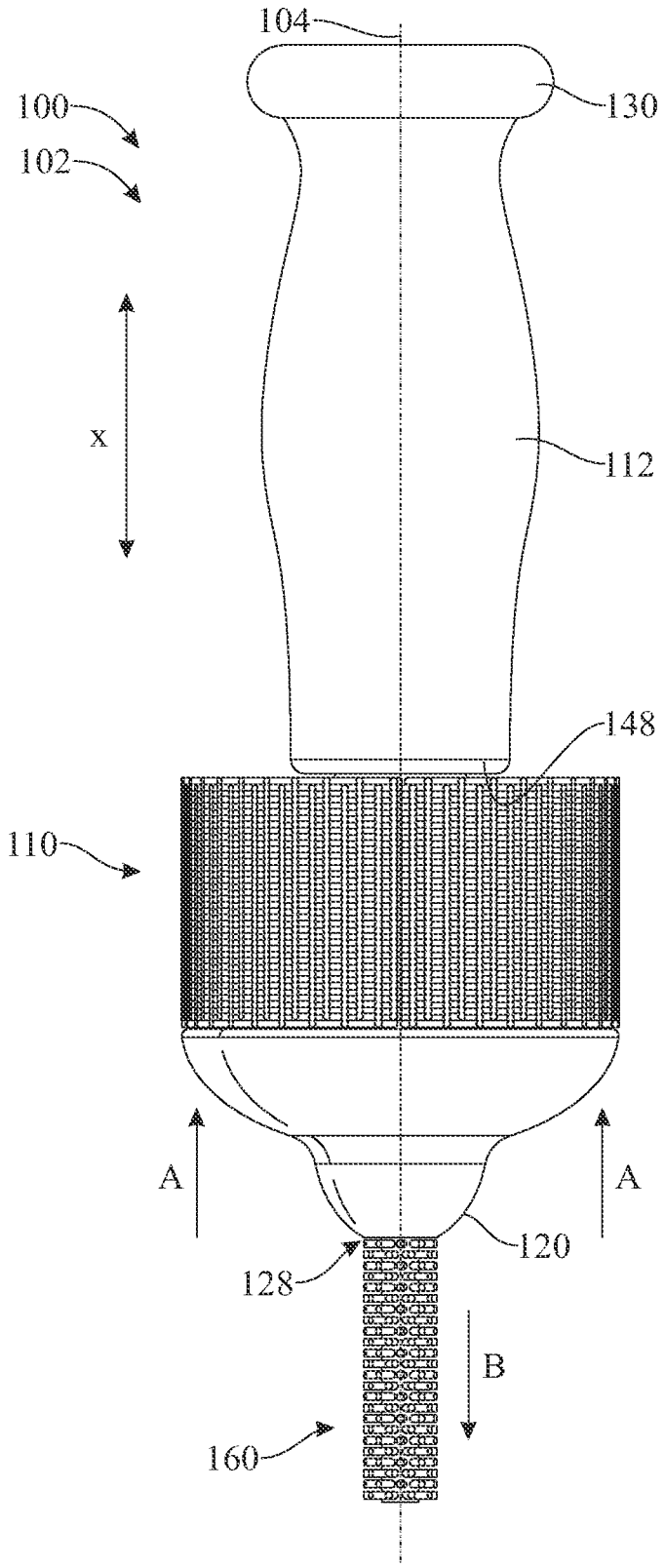
FIG. 4 presents a side elevation view of the bottle cleaning device of FIG. 1 in a compressed or retracted configuration, in which the first set of cleaning bristles are compressed or retracted to expose the second set of cleaning bristles.

As shown in FIGS. 3 and 4, the first set of bristles 110 and inner sleeve 140 are compressible towards and retractable relative to the handle 112, and the end cap 120 is also retractable relative to the handle 112, to expose a second set of bristles 160 mounted on a first or handle shaft 162 extending from the handle 112. In some embodiments, as shown, the handle shaft 162 may be integrally formed with the handle 112 into a single-piece unit. In the initial, fully extended condition, as shown in FIG. 3, the second set of bristles 160 are entirely received within the channel 164 in the compressible inner sleeve 140 and within a through bore 166 defined in and formed through the end cap 120, the through bore 166 extending from the proximal face 146 and terminating in the cap opening 128. The second set of bristles 160 may be elongately formed along the longitudinal direction x, such as coaxially with the first set of bristles 110, as shown. The second set of bristles 160 of the present embodiment provides a generally cylindrical, outer brushing contour or edge and has an outer diameter D2 substantially smaller than the outer diameter D1 of the first set of bristles 110. For instance, the outer diameter D2 of the present embodiment is about one-sixth of the outer diameter D1. The outer diameter D2 may also be smaller than the width or diameter D4 of the handle 112, as shown.

The second set of bristles 160 can be formed from the same or different material than the first set of bristles 110. The second set of bristles 160 are provided to access and clean smaller diameter portions of a baby bottle such as, but not limited to, an inner part or small diameter sleeve in the baby bottle that vents the bottle and aids in preventing colic.

With continued reference to FIG. 3, a third set of bristles 170 is provided and extends from or adjacent to the base cap 130. Specifically, the third set of bristles 170 of the present embodiment is mounted on a shaft 172, the shaft 172 arranged extending distally from the base cap 130. As best shown in FIG. 3, the shaft 172 extends from and, in a preferred embodiment, is formed integrally with a distal end face 174 of the handle 112. As noted above, the base cap 130 is removably attached to the handle 112. The handle 112 defines an inner bore or channel 176 which is sized large enough to receive the third set of bristles 170 and the shaft 172 when the base cap 130 is attached to the handle 112, as shown. The third set of bristles 170 may extend radially outward and along a full periphery of the shaft 172. The third set of bristles 170 may have an outer cylindrical contour with an outer diameter of D3, which may be larger than the outer diameter D2 of the second set of bristles 160 and smaller than the outer diameter D1 of the first set of bristles 110; for instance, the outer diameter D3 of the present embodiment is about twice the outer diameter D2, and about one-third of the outer diameter D1. The third set of bristles 170 can be used to clean other areas of a baby bottle, for example a threaded outer surface or ring where the nipple of the baby bottle connects to the remainder of the baby bottle (not shown).

As with the first and second sets of bristles 110 and 160, respectively, the third set of bristles 170 may be formed from a variety of materials. Additionally, the third set of bristles may be formed integrally with the shaft 172 extending from the base cap 130 or may be formed separately and attached thereto in known manner. It should be further noted that the bristles of the first set of bristles 110, the bristles of the second set of bristles 160 and the bristles of the third set of bristles 170 may have a same or different shape (e.g., thickness) relative to each other. For instance, in the present embodiment, the bristles of the third set of bristles 170 are thicker than those of the first and second set of bristles 110 and 160.

Turning now to FIGS. 1-5, and initially with regard to FIGS. 1 and 2, the use of the bottle cleaning device 102 to assist in cleaning a bottle, for example a baby bottle having a main bottle, a cap having a nipple, a colic preventing tube or part, and a ringed or other connection between the main bottle and the cap, will now be described. Initially, the user would soak or otherwise wet the main bottle and cap with a bio-compatible cleaning solutions. The bottle cleaning device 102 may then be grasped by the handle 112, which may be facilitated by the longitudinal arrangement and convex or other ergonomic shape of the handle 112. The user may then operate the bottle cleaning device 102 by manipulating the handle 112, to thereby operate the first set of bristles 110 to clean and scrub the main bottle inside and out. A large portion of the cap may also be cleaned and scrubbed with the first set of bristles.

The cap can be removed from the main bottle for further cleaning. In order to clean the narrower diameter colic vent, the second set of bristles 160 of the bottle cleaning device 102 will be used. In order to utilize the second set of bristles 160, the user brings the bottle cleaning device 102 in the extended configuration (FIG. 3) onto the narrower diameter colic vent, and presses the end cap 120 against walls of the bottle which are adjacent to the narrower diameter colic vent opening. For example, the user may align the narrower diameter colic vent opening with the distal opening 128 of the end cap 120 and push the cleaning device 102 forward (distally) causing the end cap 120 to push on adjacent walls, which may for instance be arranged surrounding the narrower diameter colic vent. Consequently, reaction forces are applied to the end cap 120 in the direction indicated by arrows A (FIG. 4), causing the end cap 120 to move rearward or proximally with respect to the handle 112 and against the bias of the biasing spring 150 (FIG. 3).

As the end cap 120 is moved in the direction of arrows A, the proximal face 146 of the end cap 120 pushes proximally on the compressible inner sleeve 140 and biasing spring 150, causing the inner sleeve 140, first set of bristles 110, and biasing spring 150 to compress towards the distal face 148 of the handle 112. The inner sleeve 140 and biasing spring 150 may abut against the distal face 148 of the handle 112 to facilitate such compression. In addition, as the end cap 120 is moved in the direction of arrows A and the first set of bristles 110, inner sleeve 140, biasing spring 150, and end cap 120 are retracted towards the handle 112, the second set of bristles 160 effectively passes and protrudes through the opening 128 in the end cap 120 in the direction of arrow B, causing the second set of bristles 160 to protrude distally from the end cap 120 and become exposed. Thereafter, the second set of bristles 160 can be used to clean the colic vent of the baby bottle as well as any other smaller parts, while the end cap 120 and other retractable parts remain retracted by the end cap 120 abutting against surfaces adjacent to the colic vent or other smaller parts. Having the handle 112, handle shaft 162, first set of bristles 110, second set of bristles 160 and through bore 166 coaxial may facilitate intuitive use of the device and efficient forward force exertion on the end cap 120 via the handle 112 in order to compress the device and thereby expose the second set of bristles 160.

For example, the end cap 120 may be retracted simply by pressing the end cap 120 against a proximal end of the colic vent forcing the second set of bristles 160 through the opening 128 in the end cap 120 and into the colic vent of the baby bottle. Once the user is done using the second set of bristles 160, pressure may be removed from the end cap 120 by pulling the bottle cleaning device 102 proximally and away from the adjacent surfaces, to retract the second set of bristles 160 back into the through bore 166 in the end cap 120 and the channel 164 in the inner sleeve 140. Specifically, the biasing spring 150 biases the end cap 120, and thus the first set of bristles 110 and inner sleeve 140, in the opposite direction of arrows A, out and over the second set of bristles to the fully extended condition. It should be noted that, in some embodiments, such as the present embodiment, the second end 144 of the inner sleeve 140 may be attached to or otherwise affixed to the end cap 120; for example, in the present embodiment, the second end 144 of the inner sleeve 140 is integrally formed with the proximal face 146 of the end cap 120. Alternatively or additionally, the inner sleeve 140 may be elastically compressible and biased to expand oppositely to arrows A.

In some embodiments, as shown in FIG. 3, the outer diameter D1 of the first set of bristles 110 may be larger than a width or diameter D4 of the handle 112, which may facilitate manipulating the first set of bristles 110 with the handle 112. Alternatively or additionally, the diameter D1 of the first set of bristles 110 may be about the same as the width or diameter D5 of the end cap 120, as best shown in FIG. 3; this may help cover or protect the first set of bristles 110 during protrusion and use of the second set of bristles 160, and contribute to a more precise use of the second set of bristles 160.

Figure 5:
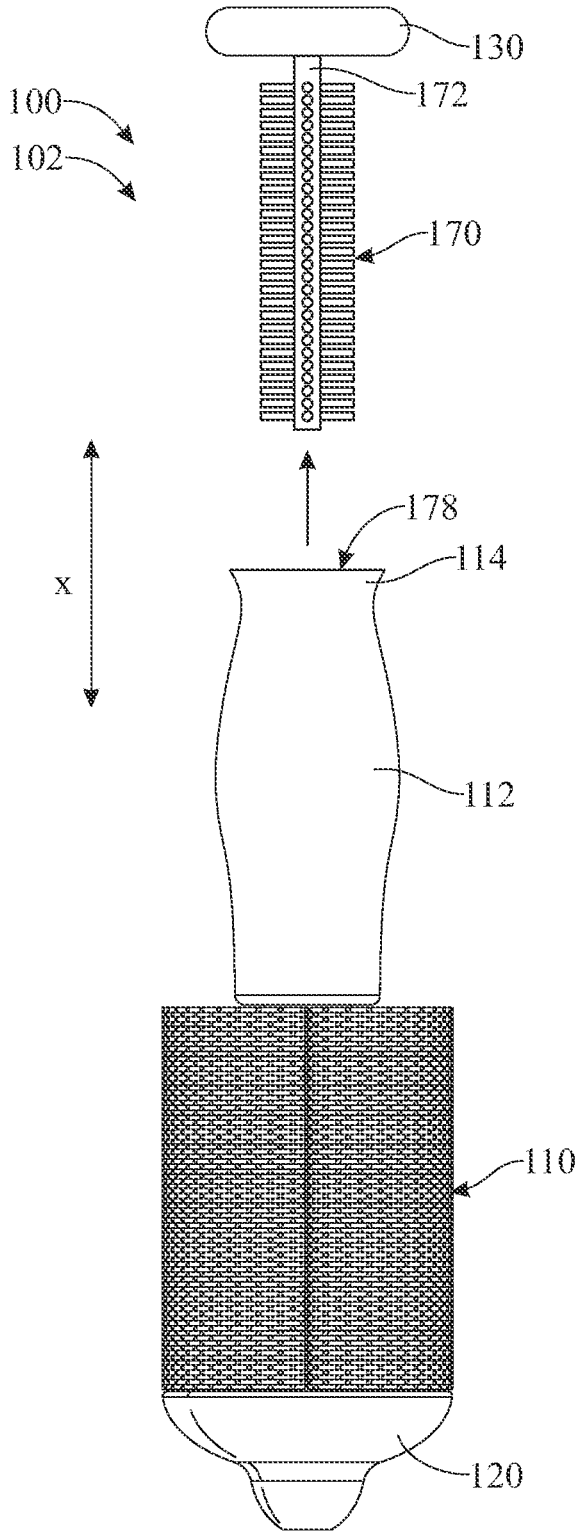
FIG. 5 presents a side elevation view of the bottle cleaning device of FIG. 1, with the third set of cleaning bristles removed from the handle of the bottle cleaning device of the present invention.

Turning now to FIG. 5, in order to clean other parts of the baby bottle, for example a threaded or ring connection between the cap and the main bottle, the third set of bristles 170 may be utilized. For this purpose, the third set of bristles 170 may be removed from the handle 112. Specifically, the base cap 130 may pulled, threaded, or otherwise detached from the first end 114 of the handle 112 and the third set of bristles 170 removed from the channel 176 in the handle 112 through an opening 178 in the first end 114 of the handle 112. Thereafter, the third set of bristles 170 may be used to clean a ring connection between the main bottle and the cap and any other parts.

As noted hereinabove, the first, second and third sets of bristles 110, 160 and 170, respectively, may be formed from different materials giving the first, second and third sets of bristles 110, 160 and 170 different scrubbing characteristic, such as, but not limited to, stronger or gentler scrubbing effects depending on the stiffness or softness of the individual bristles. Additionally, the differing diameters D1, D2 and D3 of the first, second and third sets of bristles 110, 16 and 170, respectively, allow for different diameter portions of a baby bottle to be cleaned with the same device, i.e., the disclosed bottle cleaning device 102.

Figure 6:
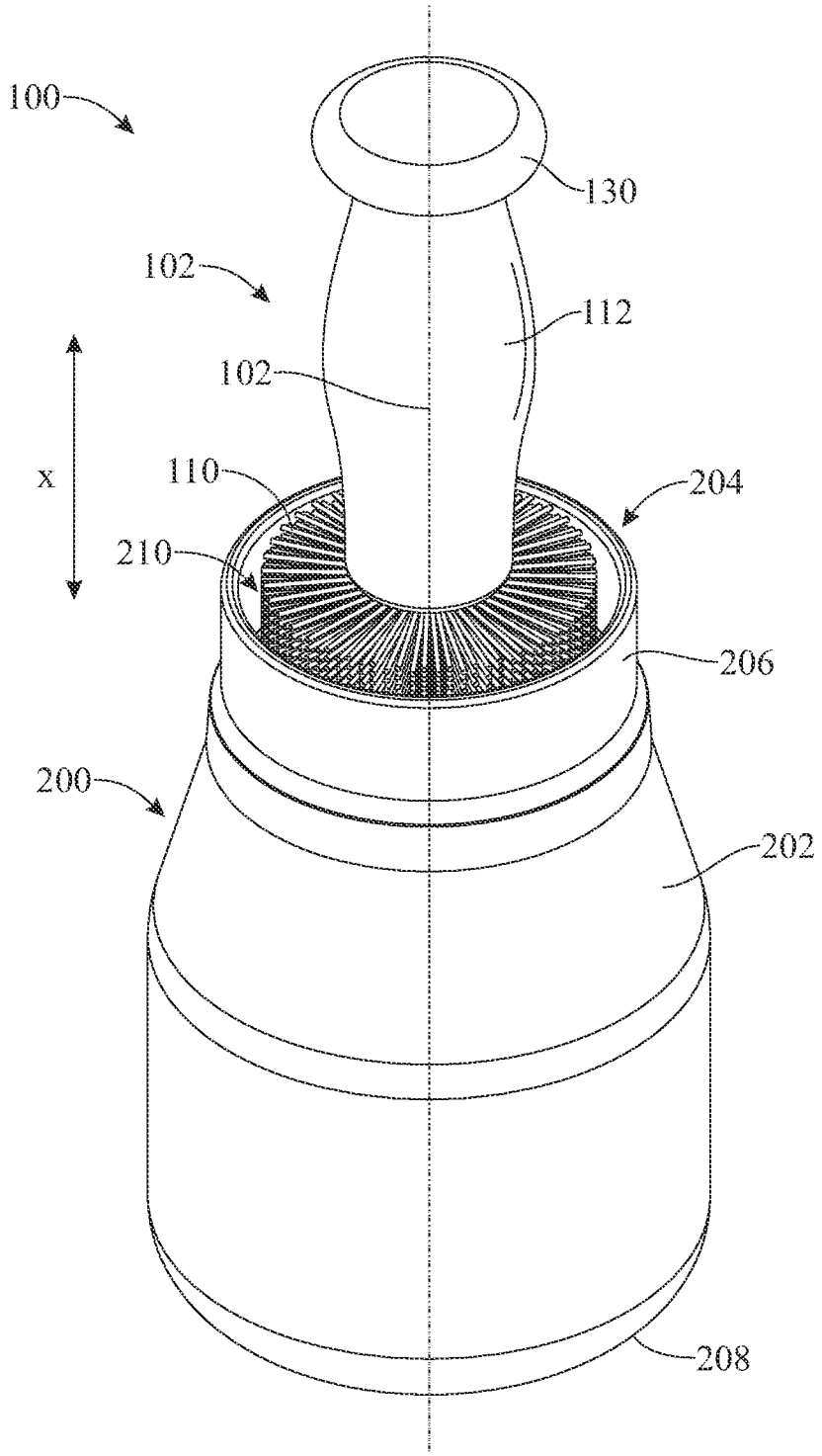
FIG. 6 presents an isometric view of the bottle cleaning device received inside a storage base, in accordance with one embodiment of the present invention.

Referring to FIG. 6, in order to keep the disclosed multi-bristle bottle cleaning device 102 clean and sanitary while not in use, the bottle cleaning system 100 may further include a storage base 200 configured to hold the bottle cleaning device 102. The storage base 200 depicted herein includes a body portion 202 having an opening 204 at a top end 206 thereof and a flat bottom or second end 208 for resting on a counter, floor or other surface. The body portion 202 of the storage base 200 defines a chamber 210 therein for receipt of the first set of bristles 110 of the bottle cleaning device 102. It should be noted that, during storage of the bottle cleaning device 102 in the chamber 210 of the storage base 200, the chamber 210 may be filled with a cleaning and/or sterilizing solution to keep the bottle cleaning device 102 clean and sterile while not in use. The cleaning and/or sterilizing solution may penetrate the channel 164 via the distal opening 128 formed in the end cap 120 and further clean and/or sterilize the second set of bristles 160. In turn, the third set of bristles 170 may be removed from the handle 112 for cleaning and/or sterilizing. While not specifically shown, the storage base 200 may additionally include a cover for covering the entire bottle cleaning device 102 when the bottle cleaning device 102 is deposited in the body portion 202.

It should be noted that one or both of the second or third set of bristles 160 and 170, respectively, may be replaced with a small diameter wire for clearing and cleaning very small diameter parts of a bottle. The disclosed bottle cleaning system 100 provides a single device containing multiple bristle sizes for use in cleaning various parts of a bottle.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A bottle cleaning system comprising a bottle cleaning device, the bottle cleaning device comprising:

a handle;

a handle shaft, affixed to and extending from the handle in a longitudinal direction;

an end cap, comprising a through bore arranged in the longitudinal direction, the end cap arranged in spaced-apart configuration with the handle and movable longitudinally towards and away from the handle;

a sleeve, elongately formed between and extending longitudinally from the handle and the end cap, the sleeve defining a channel formed longitudinally through the sleeve, wherein the sleeve is compressible and expandable along the longitudinal direction;

a longitudinally compressible and expandable, first set of bristles, carried by the sleeve; and a second set of bristles, carried by the handle shaft, wherein the second set of bristles is longitudinally movable within and along the channel of the sleeve and the through bore of the end cap; wherein the sleeve and first set of bristles are compressible towards the handle, and the second set of bristles is exposable out of the through bore of the end cap, by a longitudinal movement of the end cap towards the handle; and further wherein the sleeve and first set of bristles are expandable away from the handle, and the second set of bristles is retractable into the through bore of the end cap, by a longitudinal movement of the end cap away from the handle.

2. The bottle cleaning system of claim 1, wherein the handle shaft is non-movable longitudinally relative to the handle.

3. The bottle cleaning system of claim 1, wherein the second set of bristles is non-movable longitudinally relative to the handle.

4. The bottle cleaning system of claim 1, wherein the handle is elongately formed in the longitudinal direction.

5. The bottle cleaning system of claim 4, wherein the handle, handle shaft, sleeve, through bore of the end cap, first set of bristles, and second set of bristles are coaxial along a central axis formed in the longitudinal direction.

6. The bottle cleaning system of claim 1, wherein the bottle cleaning device is spring-biased to move the end cap longitudinally away from the handle, to expand the sleeve and first set of bristles away from the handle, and to retract the second set of bristles and handle shaft into the through bore of the end cap.

7. The bottle cleaning system of claim 6, wherein the bottle cleaning device comprises a compression spring extending longitudinally from and between the handle to the end cap.

8. The bottle cleaning system of claim 7, wherein the handle shaft and the second set of bristles extend longitudinally through and along the compression spring.

9. The bottle cleaning system of claim 1, wherein the sleeve extends from and is integrally formed with an underside of the end cap.

10. The bottle cleaning system of claim 9, wherein the sleeve is integrally formed with the end cap into a single-piece unit.

11. The bottle cleaning system of claim 1, wherein the first set of bristles is wider than the handle.

12. The bottle cleaning system of claim 1, wherein the second set of bristles is narrower than the first set of bristles.

13. The bottle cleaning system of claim 1, wherein the first set of bristles is integrally formed with the sleeve into a single-piece unit.

14. The bottle cleaning system of claim 1, wherein the second set of bristles is integrally formed with the handle shaft into a single-piece unit.

15. The bottle cleaning system of claim 1, wherein the handle shaft is integrally formed with the handle into a single-piece unit.

16. The bottle cleaning system of claim 1, wherein the bottle cleaning device further comprises a third set of bristles removably receivable within a cavity formed in the handle.

17. The bottle cleaning system of claim 16, wherein the handle is elongately formed in the longitudinal direction, and further wherein the bottle cleaning device comprises a base cap, the third set of bristles extending radially outward of a second shaft carried by and extending from the base cap, the base cap and second shaft mountable to the handle such that the second shaft and third set of bristles are received within the cavity and are arranged in the longitudinal direction.

18. The bottle cleaning system of claim 17, wherein the third set of bristles is wider than the second set of bristles and narrower than the first set of bristles.

19. A bottle cleaning system comprising a bottle cleaning device, the bottle cleaning device comprising:

a handle, elongately formed along a longitudinal direction;

a handle shaft, affixed to and extending from the handle in the longitudinal direction;

an end cap, comprising a through bore arranged in the longitudinal direction, the end cap arranged in spaced-apart configuration with the handle and movable longitudinally towards and away from the handle;

a sleeve, elongately formed between and extending longitudinally from the handle and the end cap, the sleeve defining a channel formed longitudinally through the sleeve, wherein the sleeve is compressible and expandable along the longitudinal direction;

a longitudinally compressible and expandable, first set of bristles, carried by the sleeve, the first set of bristles wider than the handle; and a second set of bristles, carried by the handle shaft and narrower than the first set of bristles, wherein the second set of bristles is longitudinally movable within and along the channel of the sleeve and the through bore of the end cap; wherein the sleeve and first set of bristles are compressible towards the handle, and the second set of bristles is exposable out of the through bore of the end cap, by a longitudinal movement of the end cap towards the handle; wherein the sleeve and first set of bristles are expandable away from the handle, and the second set of bristles is retractable into the through bore of the end cap, by a longitudinal movement of the end cap away from the handle; and further wherein the bottle cleaning device is spring-biased to move the end cap longitudinally away from the handle, to expand the sleeve and first set of bristles away from the handle, and to retract the second set of bristles and handle shaft into the through bore of the end cap.

20. A bottle cleaning system comprising a bottle cleaning device, the bottle cleaning device comprising:

a handle, elongately formed along a longitudinal direction;

a handle shaft, affixed to and extending from the handle in the longitudinal direction;

an end cap, comprising a through bore arranged in the longitudinal direction, the end cap arranged in spaced-apart configuration with the handle and movable longitudinally towards and away from the handle;

a sleeve, elongately formed between and extending longitudinally from the handle and the end cap, the sleeve defining a channel formed longitudinally through the sleeve, wherein the sleeve is compressible and expandable along the longitudinal direction;

a longitudinally compressible and expandable, first set of bristles, carried by the sleeve, the first set of bristles wider than the handle; and a second set of bristles, carried by the handle shaft and narrower than the first set of bristles, wherein the second set of bristles is longitudinally movable within and along the channel of the sleeve and the through bore of the end cap; wherein the sleeve and first set of bristles are compressible towards the handle, and the second set of bristles is exposable out of the through bore of the end cap, by a longitudinal movement of the end cap towards the handle; wherein the sleeve and first set of bristles are expandable away from the handle, and the second set of bristles is retractable into the through bore of the end cap, by a longitudinal movement of the end cap away from the handle; and further wherein the bottle cleaning device comprises a compression spring, the compression spring biasing the end cap longitudinally away from the handle, to expand the sleeve and first set of bristles away from the handle, and to retract the second set of bristles and handle shaft into the through bore of the end cap, wherein the handle shaft and the second set of bristles extend longitudinally through and along the compression spring.

* * * * *